US006990212B2

(12) United States Patent
Kambe

(10) Patent No.: US 6,990,212 B2
(45) Date of Patent: Jan. 24, 2006

(54) MOUNTING STRUCTURE OF SPEAKER BOX

(75) Inventor: Takashi Kambe, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 943 days.

(21) Appl. No.: 10/014,410

(22) Filed: Dec. 14, 2001

(65) Prior Publication Data

US 2003/0059077 A1 Mar. 27, 2003

(30) Foreign Application Priority Data

Sep. 21, 2001 (JP) ..... 2001-289173

(51) Int. Cl.
*H04R 25/00* (2006.01)

(52) U.S. Cl. ..... 381/386; 381/387; 381/395

(58) Field of Classification Search ..... 381/152, 381/361, 386–389, 391–393, 395; 181/171–172
See application file for complete search history.

(56) References Cited

U.S. PATENT DOCUMENTS

| | | | | |
|---|---|---|---|---|
| 4,331,841 | A * | 5/1982 | Castagna | 381/386 |
| 4,720,867 | A * | 1/1988 | Imai et al. | 381/152 |
| 5,400,412 | A * | 3/1995 | King et al. | 381/395 |
| 5,870,485 | A * | 2/1999 | Lundgren et al. | 381/388 |
| 6,101,262 | A * | 8/2000 | Haase et al. | 381/386 |
| 6,697,495 | B1 * | 2/2004 | Youn | 381/388 |

* cited by examiner

*Primary Examiner*—Suhan Ni
(74) *Attorney, Agent, or Firm*—Westerman, Hattori, Daniels & Adrian, LLP

(57) ABSTRACT

A speaker box mounting structure includes a panel provided with a plurality of speaker mounting bosses, and a speaker box provided with a plurality of lugs. An engaging projection projects from each of the bosses. The engaging projection has an enlarged engagement head which is expansively and contractively deformable. An annular elastic damper is retained by each of the lugs. The elastic dampers is fitted over the engaging projection between each boss and the enlarged engagement head for fixing the speaker box to the panel.

15 Claims, 7 Drawing Sheets

MOUNTING STRUCTURE OF SPEAKER BOX

BACKGROUND OF THE INVENTION

1. Field of the Invention

The present invention relates to a speaker box mounting structure. More particularly, the present invention relates to a speaker box mounting structure utilized for incorporating a speaker box in a display apparatus of a personal computer for example.

2. Description of the Related Art

FIGS. 6 and 7 illustrate a typical prior-art structure for incorporating a speaker system in a display apparatus provided with a liquid crystal panel or a cathode ray tube for example. In the illustrated structure, a pair of speaker boxes 92 each incorporating a speaker system are mounted to the reverse surface of a panel 91 protecting edge portions of a cathode ray tube 90. Each of the speaker boxes 92 is provided with a plurality of lugs 92*a,* whereas the panel 91 is provided with a plurality of bosses 91*a* corresponding in number to the lugs 92*a*. Each of the lugs 92*a* is fixed to a corresponding one of the bosses 91*a* with a screw 93, so that the speaker box 92 is fixed to the panel 91.

However, the above-described prior art structure has the following drawbacks.

Firstly, for mounting the speaker box 92, the screws 93 need be fastened. This work, which takes a relatively long time, is troublesome.

Secondly, since the lugs 92*a* are kept in direct contact with the bosses 91*a,* vibration of the speaker boxes 92 is transmitted to the panel 91 when the speaker unit is driven. In such a case, the panel 91 may repetitively hit against another part of the display apparatus, which may leads to the generation of unpleasant noises. Such a disadvantage is especially serious when the speaker box itself vibrates strongly due to its incorporation of a high output speaker unit.

SUMMARY OF THE INVENTION

It is therefore an object of the present invention to provide a speaker box mounting structure which enables easy mounting of a speaker box to a panel, and which is capable of preventing the panel from vibrating together with the speaker box.

A speaker box mounting structure according to the present invention comprises: a panel provided with a plurality of speaker mounting bosses; a speaker box provided with a plurality of lugs; a plurality of engaging projections each projecting from a respective one of the bosses, each of the projections having an enlarged engagement head which is expansively and contractively deformable; and a plurality of annular elastic dampers each retained by a respective one of the lugs. Each of the elastic dampers is fitted over a respective one of the engaging projections between the respective boss and the enlarged engagement head for fixing the speaker box to the panel.

According to the above-described structure, each of the elastic dampers need be fitted over the respective engaging projection for fixing the speaker box to the panel. Therefore, compared with screw mounting, the operation of fixing the speaker box to the panel may be performed much more easily in a shorter time. Further, the elastic damper has an additional function of providing vibration insulation between the speaker box and the panel.

Preferably, each of the lugs may be formed with a cutout for retaining a respective one of the elastic dampers. In this case, the cutout may be laterally open away from the speaker box for facilitating attachment of the elastic damper to the lug.

Preferably, each of the elastic dampers may be formed with an groove for engagement with the cutout of the respective lug, thereby facilitating attachment of the elastic damper to the lug.

In a preferred embodiment, each of the elastic dampers is made of rubber having a Barcol hardness of 6–13 for example for enhancing vibration insulation. Further, each of the elastic rubber dampers may be axially compressed between the respective boss and the enlarged head of the respective engaging projection, thereby enhancing the mechanical stability of the supported speaker box.

Preferably, the enlarged engagement head of the respective engaging projection tapers away from the respective boss for facilitating the operation of fitting each of the elastic dampers over the respective engaging projection. Further, the enlarged engagement head of the respective engaging projection may be split by a slit extending toward the respective boss, thereby facilitating expansive and contractive deformation of the enlarged engagement head.

Preferably, the panel and the bosses are integrally made of synthetic resin for reducing the manufacturing cost.

Preferably, each of the bosses has an end surface formed with at least one recess.

Preferably, each of the bosses has an end surface for contact with a respective one of the elastic dampers, and the end surfaces of the bosses are contained in a same plane for keeping a uniform clearance between the panel and the supported speaker box.

The speaker box may further comprise a washer interposed between each of the elastic dampers and the enlarged engagement head of the respective engaging projection, thereby preventing the elastic damper from unexpectedly coming off the respective engaging projection.

Preferably, the panel, the bosses and the engaging projections may be integrally made of synthetic resin as one piece.

In a typical application, the panel may be a front panel of a display apparatus.

Other features and advantages of the present invention will become clearer from the detailed description given below with reference to the accompanying drawings.

DETAILED DESCRIPTION OF THE PREFERRED EMBODIMENT

A preferred embodiment of the present invention will be described below in detail with reference to the accompanying drawings.

FIGS. 1 through 5 illustrate a speaker box mounting structure embodying the present invention. As clearly shown in FIG. 1, the speaker box mounting structure of this embodiment includes a panel 1, a pair of speaker boxes 2 and a plurality of rubber dampers 3.

Figure 6:
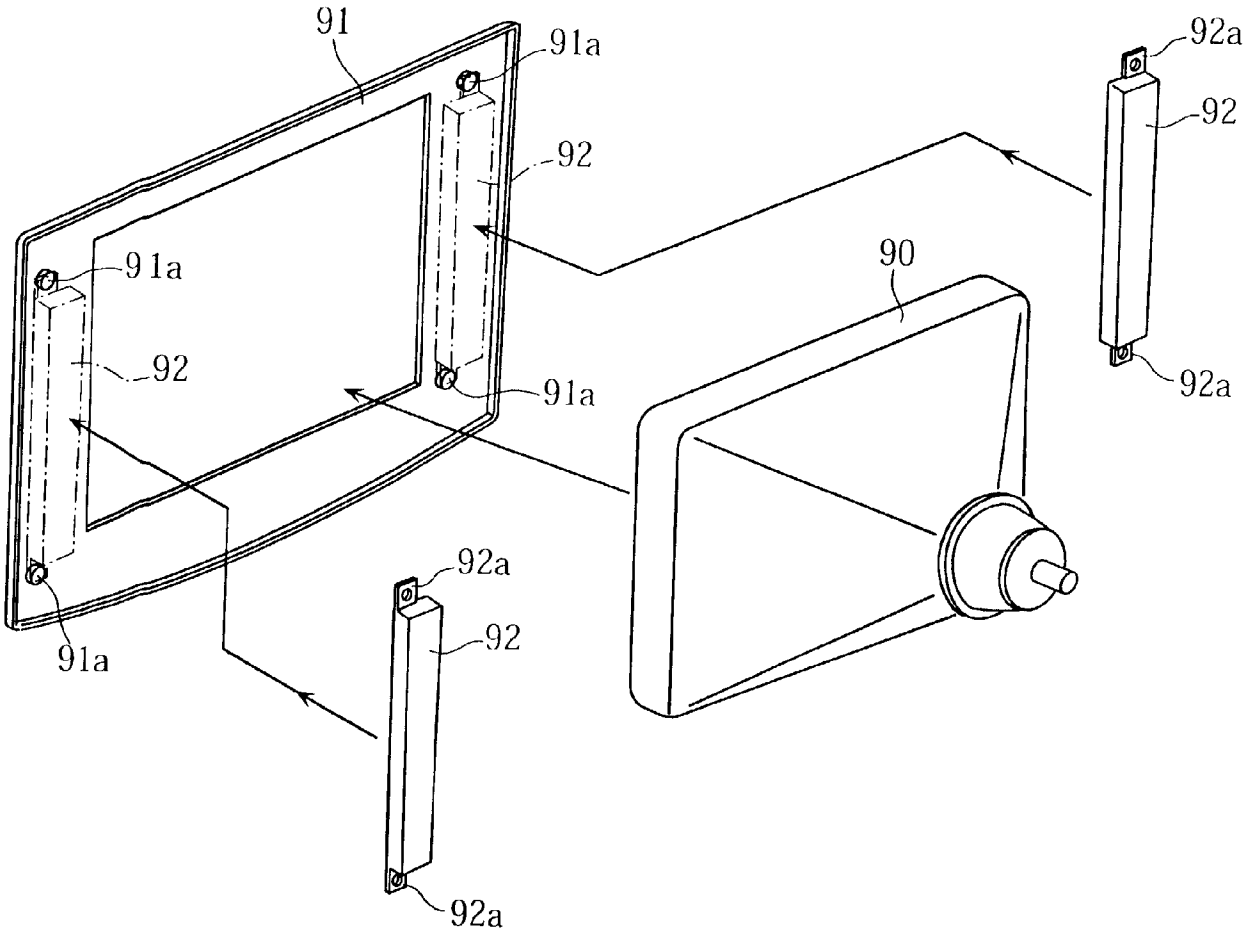
FIG. 6 PRIOR ART
FIG. 6 illustrates a prior art speaker mounting structure.
Figure 7:
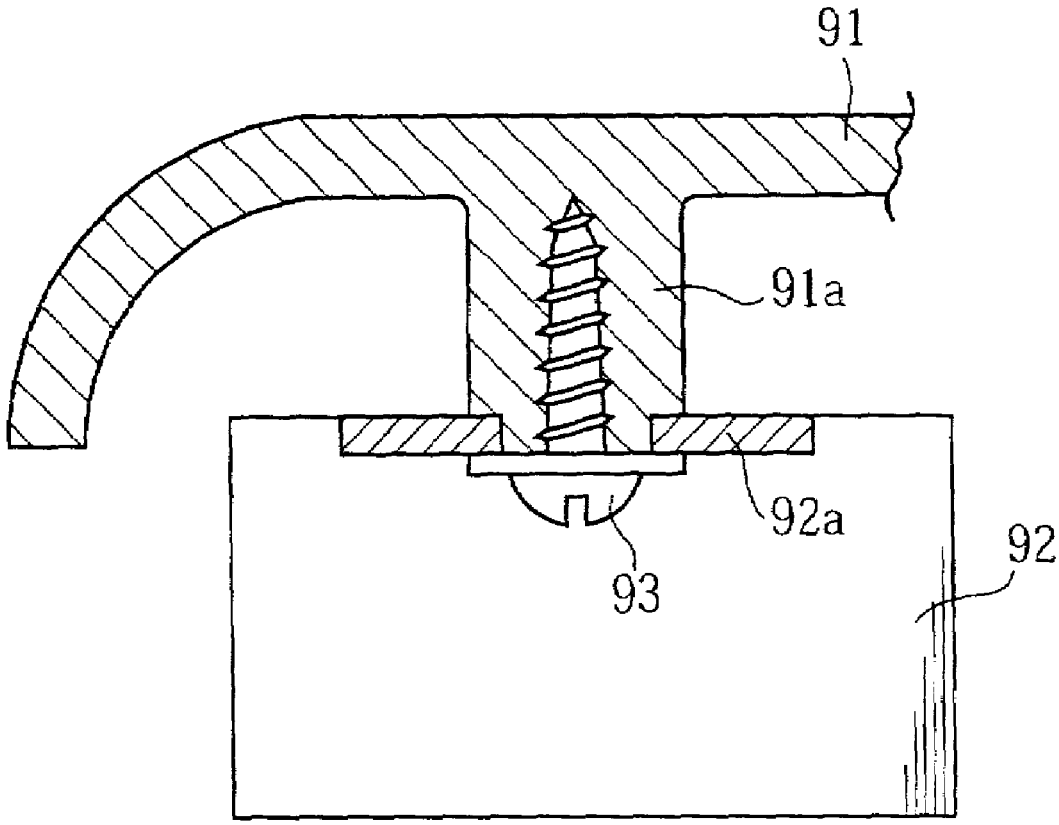
FIG. 7 PRIOR ART
FIG. 7 illustrates a prior art speaker mounting structure.

Similarly to the panel 91 of the prior art structure shown in FIG. 6, the panel 1 may be a front panel attached to the front side of a display apparatus provided with a liquid crystal display or a cathode ray tube.

The panel 1, which may be made of a synthetic resin, includes a central opening 10 for exposing the front surface of the display apparatus. Specifically, the panel 1 includes a pair of laterally extending edge portions and a pair of vertically extending edge portions for defining the opening 10. In this embodiment, each of the paired speaker boxes 2 is attached to a respective one of the vertically extending edge portions. The panel 1 is formed, on the reverse surface thereof, with a plurality of panel mounting bosses 11 utilized for attaching the panel 1 to the display apparatus for example.

Each of the speaker boxes 2 incorporates a speaker unit (now shown). The speaker box 2 has an upper end and a lower end each of which is formed with a lug 20 utilized for mounting the speaker box 2 to the panel 1. As clearly shown in FIG. 4, the lug 20 is in the form of a plate formed with a cutout 21.

Figure 1:
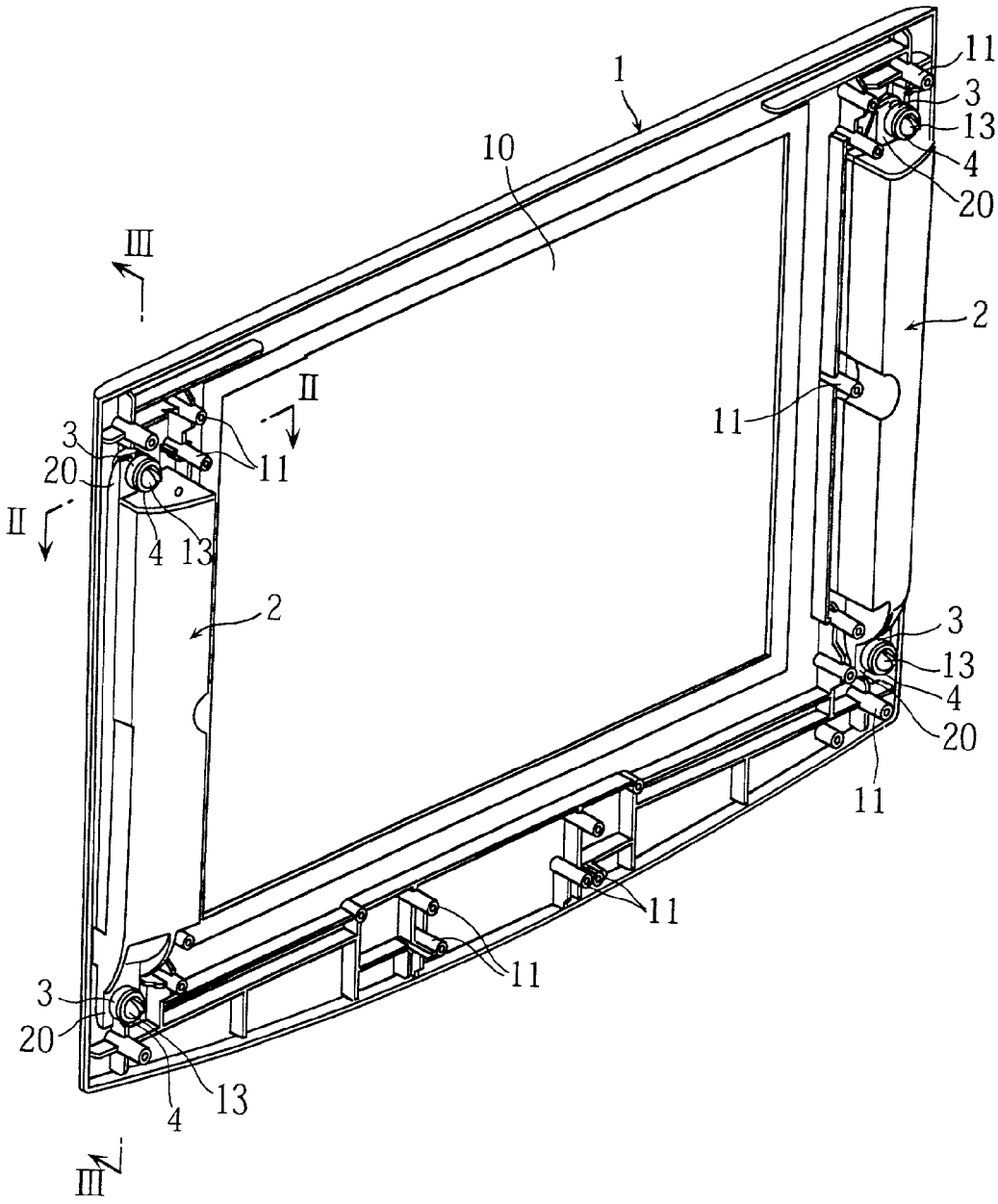
FIG. 1 is a perspective view showing a speaker box mounting structure embodying the present invention.
Figure 2:
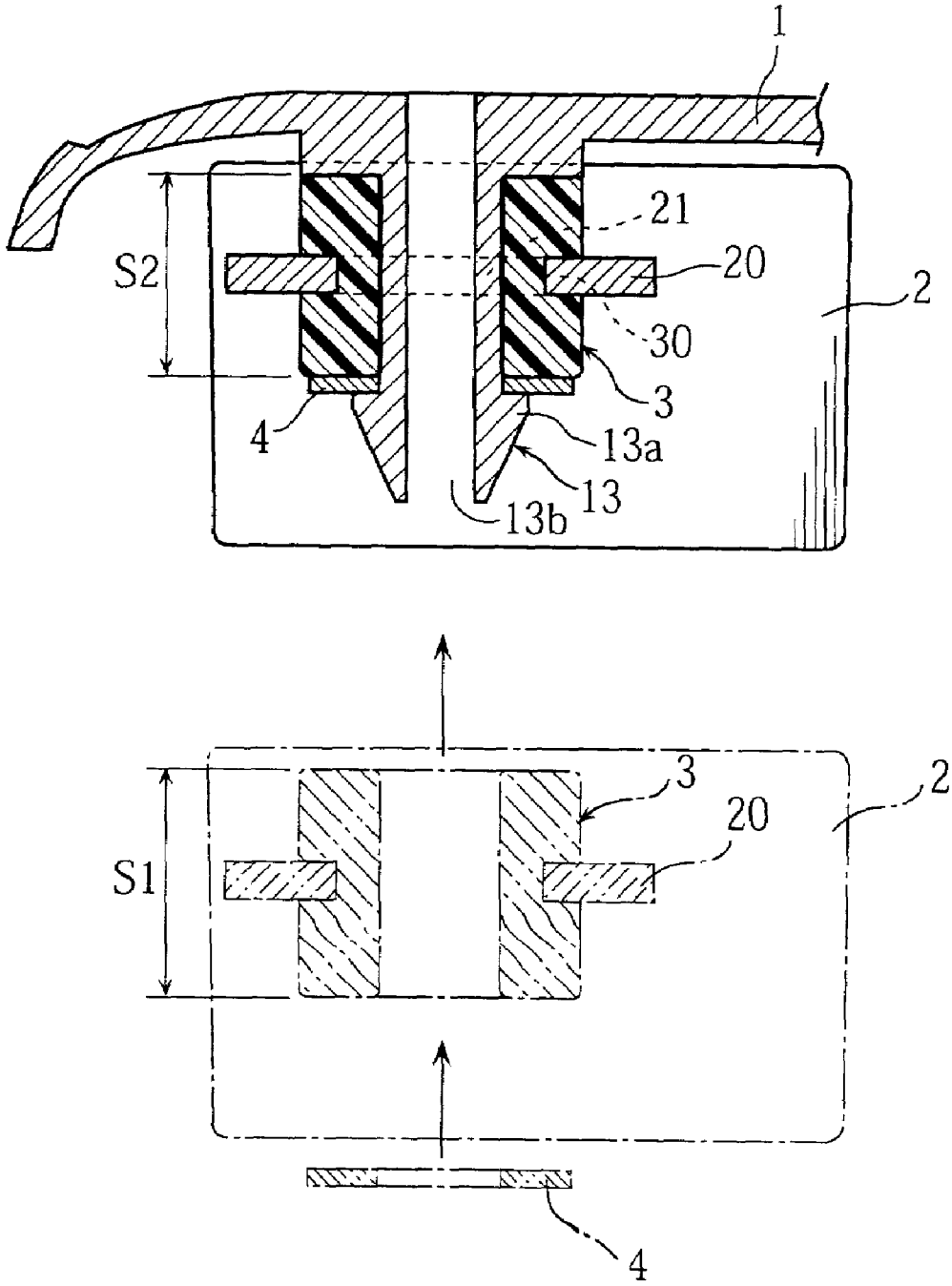
FIG. 2 is a schematic sectional view taken on lines II—II in FIG. 1.
Figure 5:
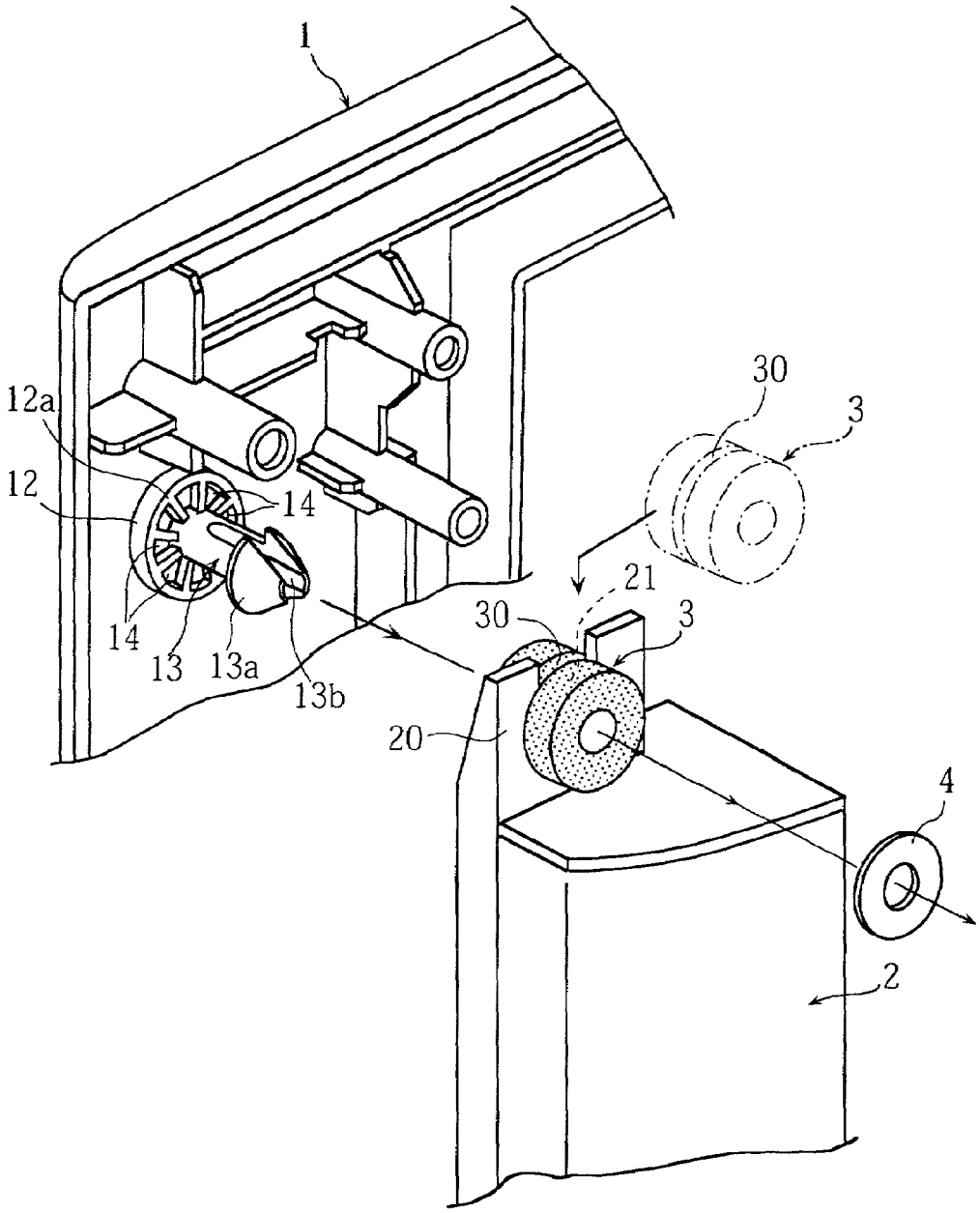
FIG. 5 is an exploded perspective view illustrating a principal portion of the mounting structure shown FIG. 1.

Each of the rubber dampers 3 is generally cylindrical and has an outer circumferential surface formed with a groove 30 provided axially centrally of the cylinder. The rubber damper 3 has a Barcol hardness of 6–13 according to JIS K 7060 (corresponding to ASTM D-2583; JIS=Japanese Industrial Standards). The rubber damper 3 maybe made of a thermoplastic elastomer for example. As shown in FIGS. 2 and 5, the rubber damper 3 is retained by the corresponding lug 20 with the groove 30 held in engagement with the cutout 21 of the lug 20. Though the illustrated cutout 21 is laterally open away from the speaker box 2, the cutout may be a complete hole for coming into engagement with the groove 30 of the rubber damper 3 by elastically deforming the rubber damper 3.

For mounting the speaker boxes 2 to the panel 1, the panel 1 is provided, on the reverse surface thereof, with four circular or annular speaker mounting bosses 12, and engaging projections 13 projecting from the respective bosses 12. The panel 1 including the bosses 12 and the projections 13 are integrally formed as one piece by resin-molding.

Figure 3:
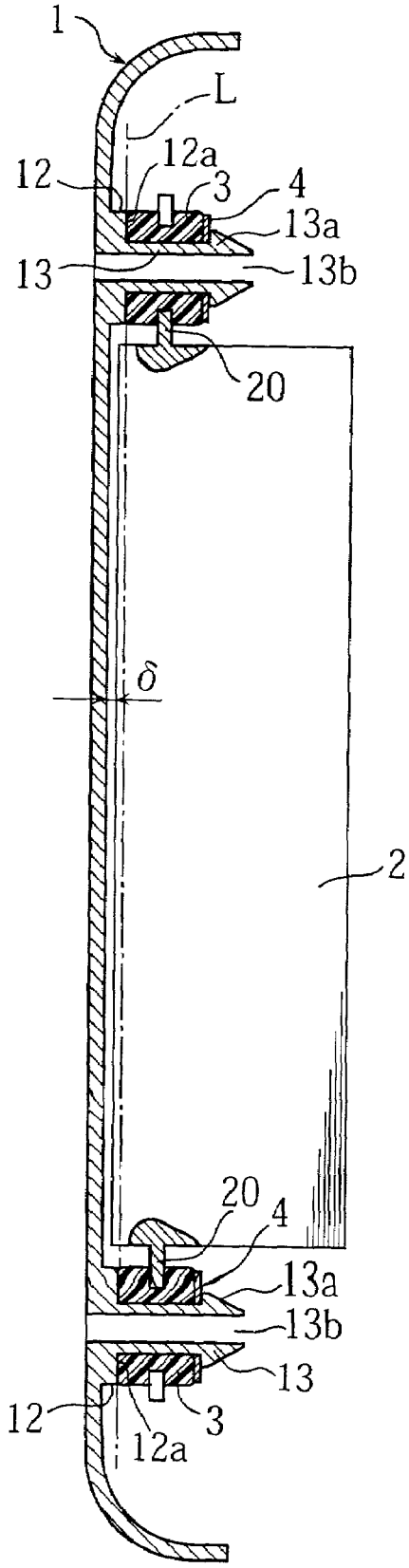
FIG. 3 is a schematic sectional view taken on lines III—III in FIG. 1.
Figure 4:
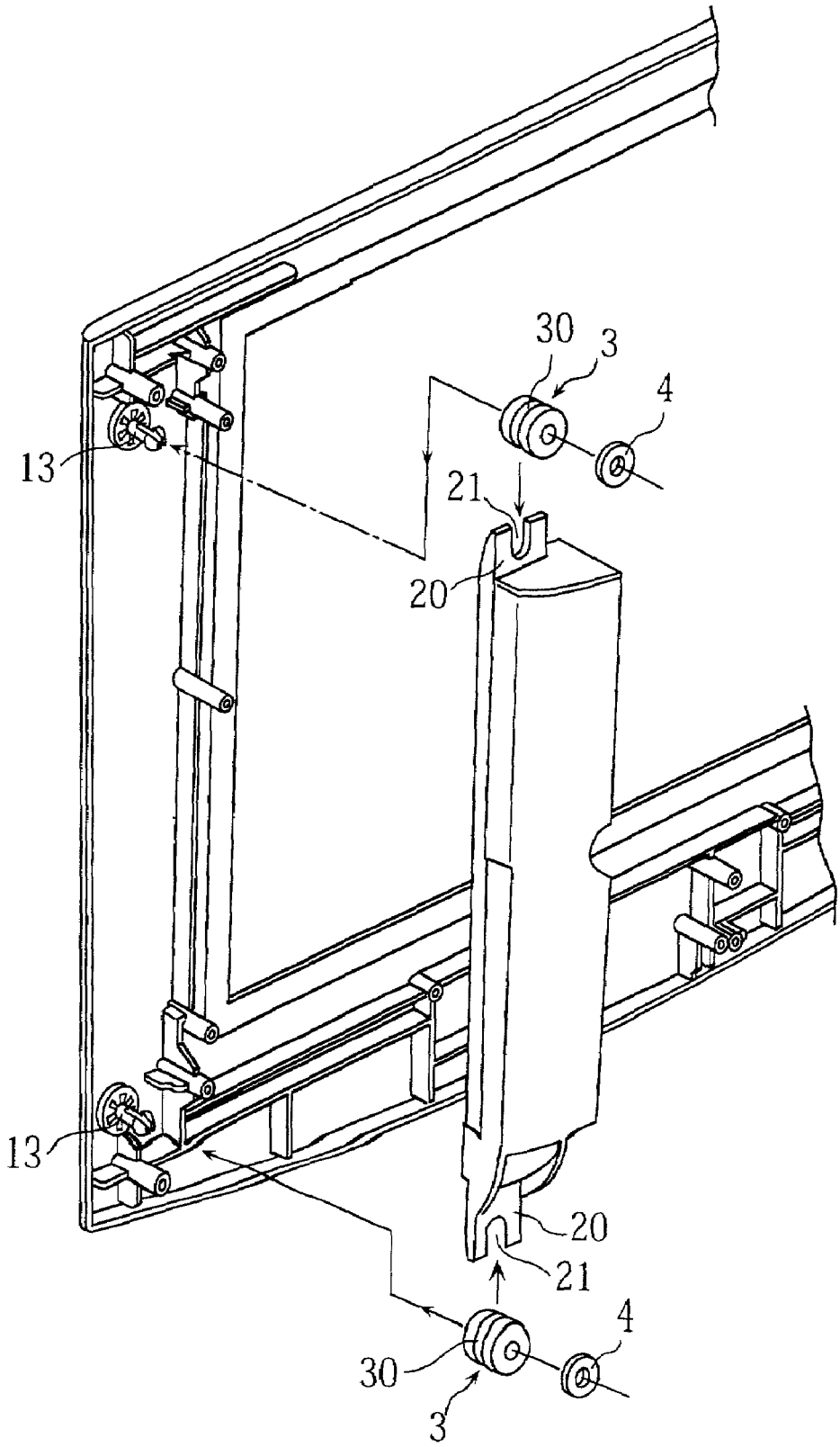
FIG. 4 is an exploded perspective view illustrating a principal portion of the mounting structure shown FIG. 1.

As clearly shown in FIG. 3, each of the speaker boxes 2 is fixed by utilizing a vertically spaced pair of the bosses 12 each having a bearing end surface 12*a*. The end surfaces 12*a* of the bosses 12 are contained in a same plane, as indicated by the phantom line L in FIG. 3. Further, as clearly shown in FIG. 5, each of the bosses 12 is formed, at the end surface 12*a*, with a plurality of circumferentially spaced sector-shaped recesses 14.

Each of the engaging projections 13 includes a shaft portion, and an enlarged engagement head 13*a* at the tip end of the shaft portion. The enlarged engagement head 13*a* gradually tapers away from the relevant boss 12. Further, the enlarged engagement head 13*a* is formed with a splitting slit 13*b* axially extending into the shaft portion. Owing to the provision of the slit 13*b*, the enlarged engagement head 13*a* is expansively and contractively deformable radially of the shaft portion.

As clearly shown in FIG. 2, each of the rubber dampers 3 retained in the cutout 21 of the lug 20 is fitted over a corresponding one of the engaging projections 13. Such fitting may be carried out by forcing the rubber damper 3 onto the projection 13 so as to diametrically reduce the enlarged engagement head 13*a*. When the rubber damper 3 passes over the enlarged engagement head 13*a* to fit around the shaft portion, the enlarged engagement head 13*a* elastically restores to its original state. As a result, the rubber damper 3 is prevented from coming off from the engaging projection 13. In the illustrated embodiment, a metal washer 4 is further fitted around the engaging projection 13 so that the rubber damper 3 is sandwiched between the washer 4 and the boss 12. The washer 4 has an inner diameter which is smaller than the maximum diameter of the enlarged engagement head 13*a* while having an outer diameter which is larger than the maximum diameter of the enlarged engagement head 13*a*. When fitted to the engaging projection 13, the rubber damper 3 is compressed axially of the engaging projection 13. Thus, the rubber damper 3 having had a length S1 in its original state (depicted by phantom lines in FIG. 2) has a length S2 which is smaller than the length S1 after compression. The rate of compression c ($c=(S1-S2)/S1$) may be approximately 10% for example. Such a compression rate allows further deformation of the rubber damper 3 in the axial direction of the engaging projection 13.

The above-described mounting structure has the following advantages.

Firstly, in the above-described structure, the speaker box 2 can be mounted by fitting the rubber damper 3 retained by the lug 20 and the washer 4 over the engaging projection 13 of the panel 1 in the mentioned order. Therefore, it is possible to mount the speaker box 2 easily and quickly without the need for screwing. Moreover, the rubber damper 3 can be easily retained in the lug 20 by engaging the groove 30 of the rubber damper 3 with the cutout 21 of the cutout 21.

The washer 4 is made of a hard material (metal in the illustrated embodiment), and can be reliably held in engagement with the enlarged engagement head 13*a*, thereby preventing the engaging projection 13 from easily coming off the engaging projection 13. The washer 4 has an outer diameter which is larger than the maximum diameter of the enlarged engagement head 13*a*, and therefore has a large contact area with the rubber damper 3 to provide additional come-off prevention for the rubber damper 3. Moreover, since the rubber damper 3 is constantly kept axially compressed, the resilient force of the rubber damper 3 functions to make the speaker box 2 stably fixed at a predetermined position.

The rubber damper 3 serves as a vibration-insulating damper. Therefore, even when the speaker box 2 vibrates in driving the speaker unit housed therein, the vibration is absorbed by the rubber damper 3 and is not directly transmitted to the panel 1. Therefore, it is possible to prevent the panel 1 from vibrating together with the speaker box 2, thereby prevent generation of unpleasant noises.

Particularly, in the illustrated embodiment, the rubber of the rubber damper 3 has a Barcol hardness of 6–13, which is considerably lower (softer) than that of a conventional rubber damper (Barcol hardness of 40 for example). In the speaker box mounting structure, a softer rubber damper provides higher vibration insulation while providing less stable support for the speaker box 2. In the illustrated embodiment, unstable support is compensated for by axially compressing the soft rubber damper 3 in the assembled state. The inventor has found through experiments that, for a speaker box having a relatively low mass of no more than 100 grams (which is the entire mass including the built-in speaker unit), the rubber damper having a Barcol hardness in the above-described range (most preferably a Barcol hardness of 8) is suitable for providing excellent vibration insulation and mechanical support.

In designing a speaker box mounting structure, various conditions such as the mass of a speaker box or the output of a speaker need be considered for effectively preventing vibration transmission. However, the rubber damper 3 can exhibit desired vibration insulation by changing e.g. the size of the rubber damper 3 depending on the variations of the conditions. Therefore, it is basically unnecessary to change the hardness of the rubber damper 3.

As described with reference to FIG. 3, the end surfaces 12*a* of the paired bosses 12 are contained in the same plane indicated by the phantom line L. As a result, the contact surfaces of the two rubber dampers 3 held in contact with the end surfaces 12*a* are also contained in the same plane. With this structure, it is possible to easily provide an arrangement wherein the speaker box 2 is held in parallel to the panel 1 with a small clearance δ uniformly defined between the front surface of the speaker box 2 and the reverse surface of the panel 1 for example, thereby preventing the speaker box 2 from being inclined into contact with the reverse surface of the panel 1. However, the end surfaces 12*a* of the paired bosses 12 may not be contained in the same plane as long as the speaker box 2 is supported out of contact with the reverse surface of the panel 1.

The panel 1 has a large wall thickness at portions at which the bosses 12 are provided. Generally, in resin-molding, shrink marks are likely to be formed at a large-thickness portion where the resin volume is large. However, according to the illustrated embodiment, the resin volume is reduced at each of the bosses 12 is reduced by the presence of the recesses 14. Therefore, it is possible to prevent the formation of shrink marks at the end surface 12*a* of the boss 12 for ensuring the flatness of the end surface 12*a*.

According to the present invention, the panel for mounting a speaker box need not be the front panel of a display apparatus, and the speaker box may be mounted onto any kind of panel which requires speaker-mounting. Further, the structure of the speaker box itself is not limitative on the present invention.

Moreover, instead of forming lugs integrally with the speaker box, lugs formed separately from the speaker box may be attached to the speaker box.

Further, the rubber damper is only an example of elastic damper according to the present invention. Therefore, any other kind of elastic damper may be utilized as long as it has the function required for embodying the present invention. Furthermore, the elastic damper may have a hardness other than those specified in the above-described embodiment.

The present invention being thus described, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A speaker box mounting structure comprising:

a panel provided with a plurality of speaker mounting bosses;

a speaker box provided with a plurality of lugs;

a plurality of engaging projections each projecting from a respective one of the bosses, each of the projections having an enlarged engagement head which is expansively and contractively deformable; and a plurality of annular elastic dampers each retained by a respective one of the lugs;

wherein each of the elastic dampers is fitted over a respective one of the engaging projections between the respective boss and the enlarged engagement head for fixing the speaker box to the panel.

2. The speaker box mounting structure according to claim 1, wherein each of the lugs is formed with a cutout for retaining a respective one of the elastic dampers.

3. The speaker box mounting structure according to claim 2, wherein the cutout is laterally open away from the speaker box.

4. The speaker box mounting structure according to claim 2, wherein each of the elastic dampers is formed with an groove for engagement with the cutout of the respective lug.

5. The speaker box mounting structure according to claim 1, wherein each of the elastic dampers is made of rubber.

6. The speaker box mounting structure according to claim 5, wherein each of the elastic rubber dampers is axially compressed between the respective boss and the enlarged head of the respective engaging projection.

7. The speaker box mounting structure according to claim 1, wherein the elastic damper is made of rubber having a Barcol hardness of 6–13.

8. The speaker box mounting structure according to claim 1, wherein the enlarged engagement head of the respective engaging projection tapers away from the respective boss.

9. The speaker box mounting structure according to claim 1, wherein the enlarged engagement head of the respective engaging projection is split by a slit extending toward the respective boss.

10. The speaker box mounting structure according to claim 1, wherein the panel and the bosses are integrally made of synthetic resin.

11. The speaker box mounting structure according to claim 10, wherein each of the bosses has an end surface formed with at least one recess.

12. The speaker box mounting structure according to claim 1, wherein each of the bosses has an end surface for contact with a respective one of the elastic dampers, the end surfaces of the bosses are contained in a same plane.

13. The speaker box mounting structure according to claim 1, further comprising a washer interposed between each of the elastic dampers and the enlarged engagement head of the respective engaging projection.

14. The speaker box mounting structure according to claim 1, wherein the panel, the bosses and the engaging projections are integrally made of synthetic resin as one piece.

15. The speaker box mounting structure according to claim 1, wherein the panel is a front panel of a display apparatus.

* * * * *